US006973786B1

(12) United States Patent
Liu et al.

(10) Patent No.: US 6,973,786 B1
(45) Date of Patent: Dec. 13, 2005

(54) EMISSION REDUCTION IN A DIESEL ENGINE BY SELECTIVE USE OF HIGH-AND LOW-PRESSURE EGR LOOPS

(75) Inventors: Zhengbai Liu, Naperville, IL (US); Xinqun Gui, Naperville, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 0 days.

(21) Appl. No.: 10/963,076

(22) Filed: Oct. 12, 2004

(51) Int. Cl.[7] ..... F01N 3/02; F02M 25/07
(52) U.S. Cl. ..... 60/605.2; 123/559.2; 123/568.2
(58) Field of Search ..... 60/605.2; 123/559.2

(56) References Cited

U.S. PATENT DOCUMENTS 5,740,785 A 4/1998 Dickey et al.
6,301,887 B1 10/2001 Gorel et al.
6,347,619 B1 2/2002 Whiting et al.
6,412,279 B1 * 7/2002 Coleman et al. ..... 60/605.1
6,422,220 B1 7/2002 Lepp et al.
6,899,090 B2 * 5/2005 Arnold ..... 123/568.12
2004/0093866 A1 * 5/2004 Ishikawa ..... 60/605.2
2005/0103013 A1 * 5/2005 Brookshire et al. ..... 60/605.2

FOREIGN PATENT DOCUMENTS

JP 05071428 A * 3/1993 ..... F02M 25/07
JP 2002276405 A * 9/2002 ..... F02M 25/07

* cited by examiner

*Primary Examiner*—Sheldon J Richter
(74) *Attorney, Agent, or Firm*—Dennis Kelly Sullivan; Susan L. Lukasik; Jeffrey P. Calfa

(57) ABSTRACT

A compression ignition engine (10) has an EGR system operable to provide a first EGR loop (46, 52, 54) when the engine is lightly loaded and a second EGR loop (46, 52, 56) when the engine is more heavily loaded. When the first EGR loop is selected, exhaust gas is recirculated from a location upstream of a turbine (20) of a turbocharger (18) to a location downstream of the turbocharger compressor (22). When the second EGR loop is selected, exhaust gas is recirculated from a location downstream of the turbine to a location upstream of the compressor.

21 Claims, 2 Drawing Sheets

EMISSION REDUCTION IN A DIESEL ENGINE BY SELECTIVE USE OF HIGH-AND LOW-PRESSURE EGR LOOPS

FIELD OF THE INVENTION

This invention relates generally to internal combustion engines, especially compression ignition (i.e. diesel) engines. More specifically, the invention relates to a strategy for reducing tailpipe emissions from such engines through the selective use of a low-pressure EGR (exhaust gas recirculation) loop and a high-pressure EGR loop.

BACKGROUND OF THE INVENTION

The use of EGR as an addition to charge air introduced into the engine cylinders aids in controlling tailpipe emissions, especially NOx and particulates.

Because a diesel engine that powers a motor vehicle runs at different speeds and loads depending on various inputs to both the vehicle and the engine that influence engine operation, the nature of the charges created in the cylinders change as engine speed and load change. Exhaust gas recirculation requirements also change with engine speed and load changes.

A processor in an engine control system processes data indicative of parameters such as engine speed and engine load to develop control data for controlling constituents of the charges. The data developed is used to control turbocharger boost, engine fueling, and EGR rate.

Alternative combustion processes for a compression ignition engine can provide significant reductions in tailpipe emissions, NOx (oxides of nitrogen) and DPM (diesel particulate matter). Examples of alternative combustion processes include Homogeneous Charge Compression Ignition (HCCI), Controlled Auto-Ignition (CAI), Dilution Controlled Combustion Systems (DCCS), and Highly Premixed Combustion Systems (HPCS).

SUMMARY OF THE INVENTION

Briefly, the present invention relates to a compression ignition engine having two EGR loops that are selectively used to recirculate exhaust gas for reducing NOx (Nitrogen Oxides) and PM (Particulate Matter) emissions. Selection of a particular EGR loop is a function of engine load.

While the invention is useful with various turbocharged engines, its use in conjunction with alternative diesel combustion in a turbocharged engine is believed to provide significant reductions in tailpipe emissions by keeping in-cylinder temperatures significantly lower than in comparable engines operating by conventional diesel combustion.

In a presently preferred embodiment, a high-pressure EGR loop and a low-pressure EGR loop are provided by one direction control valve and two EGR valves. As a result, the high efficiency of the high-pressure EGR loop may be used to advantage at relatively lower engine loads, and the high EGR rate of the low-pressure EGR loop may be used to advantage at relatively higher engine loads.

The strategy for selection of one loop or the other is embodied in the engine control system as a programmed algorithm that is repeatedly executed by a processor.

One generic aspect of the present invention relates to a turbocharged compression ignition engine comprising engine cylinders within which combustion occurs to run the engine, an intake system through which charge air is introduced into the cylinders, an exhaust system through which products of combustion from the engine cylinders are exhausted, a turbocharger having a turbine in the exhaust system and a compressor in the intake system, a fueling system for fueling the cylinders, and an exhaust gas recirculation (EGR) system for conveying exhaust gas from the exhaust system to the intake system.

The EGR system comprises a direction control valve having an outlet, a first inlet communicated to the exhaust system upstream of the turbine, a second inlet communicated to the exhaust system downstream of the turbine, and an element that selectively communicates the inlets to the outlet to provide exhaust gas from a selected inlet to the outlet. After leaving the direction control valve outlet, exhaust gas passes through a cooler.

A first EGR valve and a second EGR valve each has a respective inlet to which exhaust gas that has passed through the cooler is delivered. When the direction control valve is selecting the first inlet, the first EGR valve controls flow of recirculated exhaust gas to a location in the intake system downstream of the compressor while the second EGR valve is closed. When the direction control valve is selecting the second inlet, the second EGR valve controls flow of recirculated exhaust gas to a location in the intake system upstream of the compressor while the first EGR valve is closed.

Another generic aspect of the invention relates to a method of controlling exhaust emission during operation of a turbocharged compression ignition engine having engine cylinders within which combustion occurs to run the engine, an intake system through which charge air is introduced into the cylinders, an exhaust system through which products of combustion from the engine cylinders are exhausted, a turbocharger having a turbine in the exhaust system and a compressor in the intake system, a fueling system for fueling the cylinders, and an exhaust gas recirculation system for conveying exhaust gas from the exhaust system to the intake system to aid in limiting in-cylinder combustion temperature.

The method comprises selecting between a first EGR loop and a second EGR loop to recirculate exhaust gas, wherein selection of the first EGR loop causes exhaust gas to be recirculated from a location upstream of the turbine to a location downstream of the compressor and selection of the second EGR loop causes exhaust gas to be recirculated from a location downstream of the turbine to a location upstream of the compressor.

Another generic aspect relates to an engine for performing the method just described.

The foregoing, along with further features and advantages of the invention, will be seen in the following disclosure of a presently preferred embodiment of the invention depicting the best mode contemplated at this time for carrying out the invention. This specification includes drawings, now briefly described as follows.

DESCRIPTION OF THE PREFERRED EMBODIMENT

Figure 1:
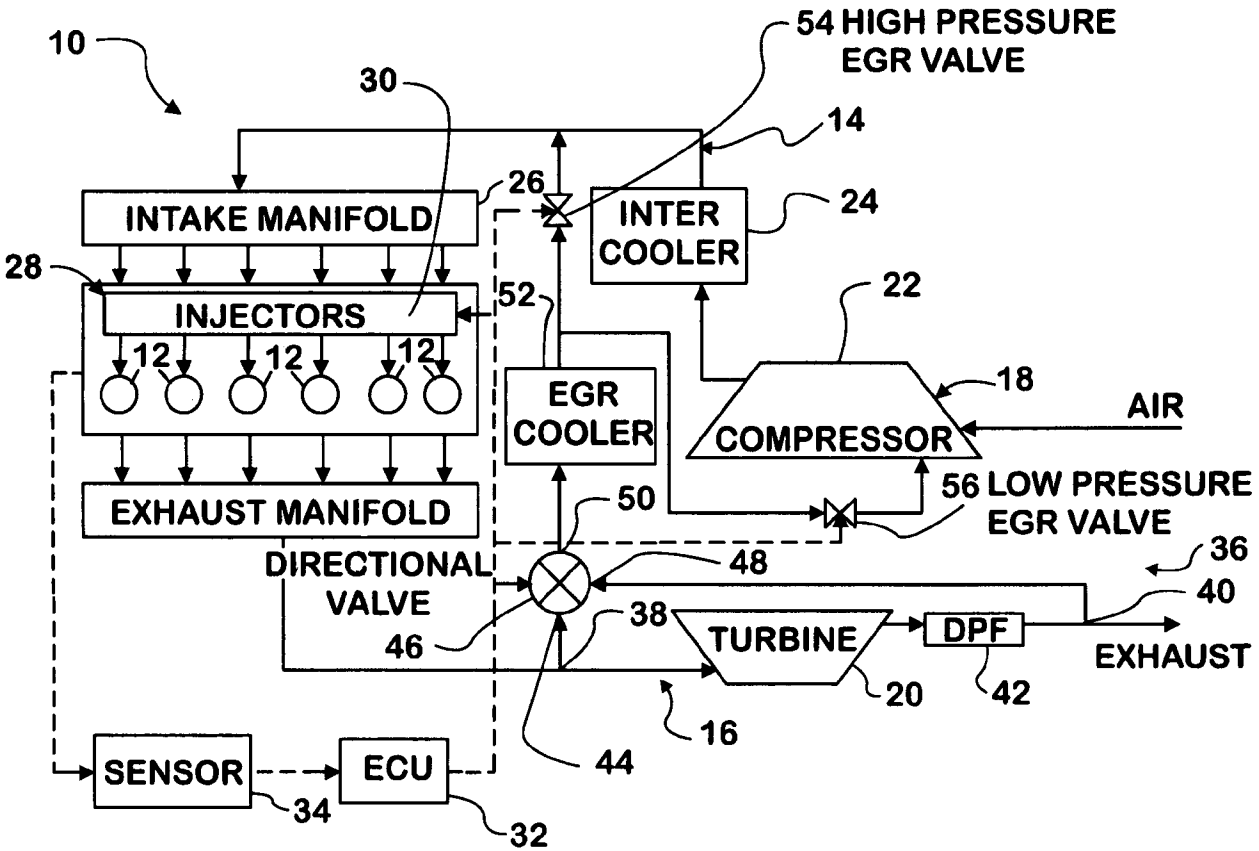
FIG. 1 is a general schematic diagram of those portions of an exemplary diesel engine relevant to principles of the present invention.

FIG. 1 shows schematically a portion of an exemplary turbocharged diesel engine 10 operating in accordance with the inventive strategy for powering a motor vehicle. Engine 10 comprises cylinders 12 within which pistons reciprocate. Each piston is coupled to a respective throw of a crankshaft by a corresponding connecting rod. Engine 10 further comprises an intake system 14 and an exhaust system 16. Turbocharging is provided by a turbocharger 18 having a turbine 20 in exhaust system 16 that operates a compressor 22 in intake system 14.

Intake system 14 further comprises an intercooler 24 downstream of compressor 22 for cooling charge air that has been drawn into intake system 14 and compressed by compressor 22. From intercooler 24 the charge air is introduced into an engine intake manifold 26 that serves cylinders 12. Charge air enters each cylinder when a respective intake valve is open during the engine cycle.

Engine 10 further comprises a fueling system 28 that comprises fuel injectors for cylinders 12. The engine also has a processor-based engine control system or unit (ECU) 32 that processes data from various sources to develop various control data for controlling various aspects of engine operation. The data processed by ECU 32 may originate at external sources, such as various sensors 34, and/or be generated internally. Examples of data processed may include engine speed, intake manifold pressure, exhaust manifold pressure, fuel injection pressure, fueling quantity and timing, mass airflow, and accelerator pedal position, but any particular algorithm that processes data in practice of the invention may not necessarily process data for all of these enumerated parameters. Typically however, a parameter or parameters that are indicative of engine load are processed in the practice of the invention.

Engine 10 further comprises an EGR system 36 between exhaust system 16 and intake system 14. EGR system 36 has a configuration that can provide either low-pressure EGR or high-pressure EGR and comprises a high-pressure inlet 38 upstream of turbine 20 and a low-pressure inlet 40 that is downstream of turbine 20.

In this particular embodiment a DPF (diesel particulate filter) 42 is disposed in the exhaust system downstream of turbine 20, but before inlet 40, so that low-pressure exhaust gas at inlet 40 is exhaust gas that has been treated by DPF 42.

Inlet 38 leads to a first port 44 of a directional valve 46, and inlet 40 to a second port 48 of valve 46. An outlet port 50 of valve 46 leads to an inlet of an EGR cooler 52. An outlet of EGR cooler 52 leads to inlet ports of respective EGR valves 54, 56.

An outlet of EGR valve 54 leads to intake system 14 between intercooler 24 and intake manifold 26. An outlet of EGR valve 56 leads to intake system 14 upstream of compressor 22. EGR valves 54, 56 and directional valve 46 are under the control of ECU 32.

Directional valve 46 operates to select either inlet 38 or inlet 40 for communication to the inlet of EGR cooler 52.

When engine 10 runs at lower loads, ECU 32 operates valve 46 to select inlet 38, keeps EGR valve 56 closed, and operates EGR valve 54 to meter cooled higher pressure exhaust gas to the boosted charge air in intake system 14. At the relatively lower loads, a major part of the exhaust gas flow passes through turbine 20 and DPF 42 before entering atmosphere. A minor part of the exhaust gas flow passes through directional valve 46, EGR cooler 52, and EGR valve 54 to entrain with the boosted charge air. Hence, directional valve 46, EGR cooler 52, and EGR valve 54 form a high pressure EGR loop that is active at relatively lower engine loads for controlling exhaust gas recirculation.

When engine 10 runs at relatively higher loads, ECU 32 operates valve 46 to select inlet 40, keeps EGR valve 54 closed, and operates EGR valve 56 to meter cooled lower pressure exhaust gas to the unboosted air entering intake system 14. At the relatively higher loads, all of the exhaust gas flow passes through turbine 20 and DPF 42, But before reaching atmosphere, a minor part of the exhaust gas flow passes through directional valve 46, EGR cooler 52, and EGR valve 56 to entrain with unboosted air entering intake system 14. Hence, directional valve 46, EGR cooler 52, and EGR valve 56 form a low pressure EGR loop that is active at relatively higher engine loads for controlling exhaust gas recirculation.

ECU 32 controls engine fueling by controlling the operation of the fueling system 28, including controlling the operation of the fuel injectors 30. The processing system embodied in ECU 32 can process data sufficiently fast to calculate, in real time, the timing and duration of device actuation to set both the timing and the amount of each injection of fuel into a cylinder. Such control capability is used in implementation of a fuel control strategy that provides the low temperature combustion (cool flame) that characterizes alternative diesel combustion processes. The use of high- and low-pressure EGR loops is advantageous when alternative diesel combustion is used to run engine 10 and is believed useful for achieving compliance with certain requirements for reduced NOx (Nitrogen Oxides) and DPM (Particulate Matter) in tailpipe emissions from motor vehicles powered by diesel engines.

The present invention can be effective over the full range of engine operating conditions. For example, data that correlates a particular EGR loop with data values for various engine loads is developed from engine tests and stored in memory of ECU 32. When the engine runs, data values for engine load are processed in conjunction with the stored data to cause the appropriate EGR loop to be selected. The extent to which the particular EGR valve in the selected loop is allowed to open is then controlled by certain processing performed by the control system processor.

The present invention can be used for heavy-duty, medium-duty, and light-duty diesel engines, and provides high thermal efficiency.

Figure 2:
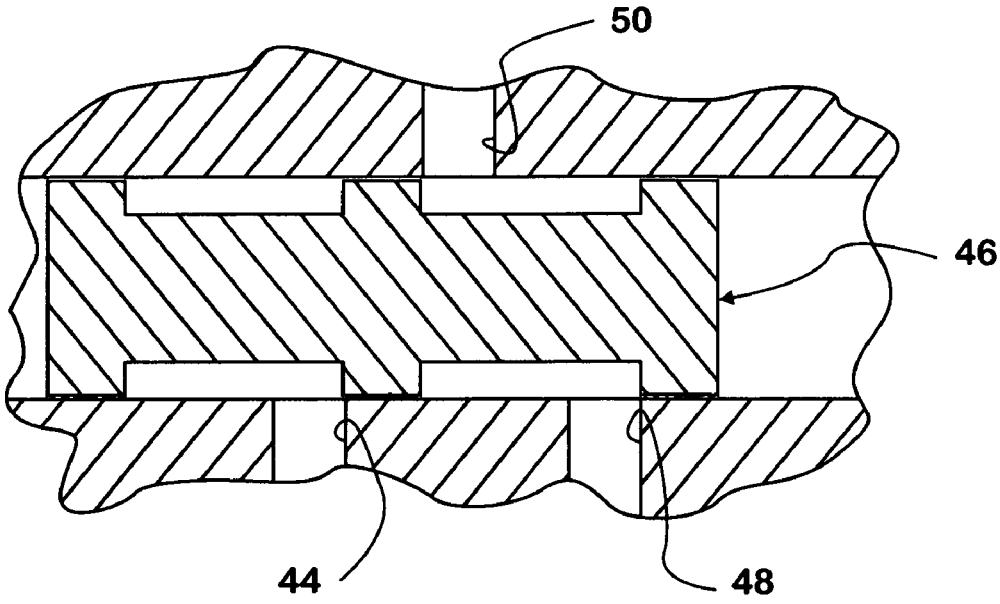
FIG. 2 is somewhat schematic cross section view through a portion of one valve that is present in FIG. 1.
Figure 3:
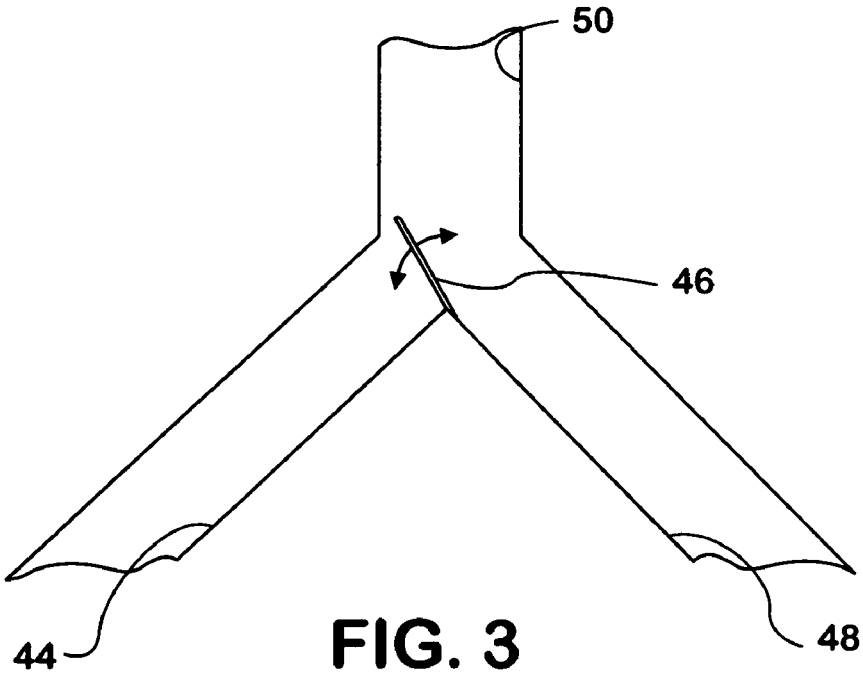
FIG. 3 is somewhat schematic cross section view through a portion of another valve that is present in FIG. 1.

The direction control valve can be a spool valve 46 as shown in FIG. 2, or a switch valve 46 as shown in FIG. 3.

While a presently preferred embodiment of the invention has been illustrated and described, it should be appreciated that principles of the invention apply to all embodiments falling within the scope of the following claims.

What is claimed is:

1. A turbocharged compression ignition engine comprising:

engine cylinders within which combustion occurs to run the engine;

an intake system through which charge air is introduced into the cylinders;

an exhaust system through which products of combustion from the engine cylinders are exhausted;

a turbocharger having a turbine in the exhaust system and a compressor in the intake system;

a fueling system for fueling the cylinders;

an exhaust gas recirculation system for conveying exhaust gas from the exhaust system to the intake system and comprising a direction control valve having an outlet, a first inlet communicated to the exhaust system upstream of the turbine, a second inlet communicated to the exhaust system downstream of the turbine, and an element that selectively communicates the inlets to the outlet to provide exhaust gas from a selected inlet to the outlet, a cooler through which exhaust gas passes after leaving the direction control valve outlet, a first EGR valve and a second EGR valve each having a respective inlet to which exhaust gas that has passed through the cooler is delivered, the first EGR valve being operable, when the direction control valve is selecting the first inlet, to control flow of recirculated exhaust gas to a location in the intake system downstream of the compressor while the second EGR valve is closed, and the second EGR valve being operable, when the direction control valve is selecting the second inlet, to control flow of recirculated exhaust gas to a location in the intake system upstream of the compressor while the first EGR valve is closed.

2. An engine as set forth in claim 1 wherein the intake system comprises an intercooler downstream of the compressor, and the first EGR valve delivers the throughflow to the intake system downstream of the intercooler.

3. An engine as set forth in claim 1 wherein the exhaust system comprises an exhaust gas treatment device downstream of the turbine and the second inlet of the direction control valve is communicated to the exhaust system downstream of the exhaust gas treatment device.

4. An engine as set forth in claim 3 wherein the exhaust gas treatment device comprises a diesel particulate filter.

5. An engine as set forth in claim 1 further including an engine control system for controlling the engine, including controlling the direction control valve and the first and second EGR valves.

6. An engine as set forth in claim 5 wherein the engine control system also controls fueling of the engine by the fueling system to cause the engine to operate, at least at times, by an alternative diesel combustion process.

7. An engine as set forth in claim 5 wherein the engine control system causes one of the EGR valves to be closed when operating the direction control valve to direct exhaust gas flow to the other EGR valve.

8. An engine as set forth in claim 7 wherein the engine control system causes the other EGR valve to be closed when operating the direction control valve to direct exhaust gas flow to the one EGR valve.

9. An engine as set forth in claim 5 wherein the engine control system comprises a processor for processing data values indicative of engine load and controlling the direction control valve and the first and second EGR valves in accordance with a result of the processing of those data values.

10. An engine as set forth in claim 9 wherein the engine control system causes the direction control valve to allow exhaust gas flow to the first EGR valve, causes the second EGR valve to be closed, and sets the extent to which the first EGR valve is allowed to open when the processing result discloses the engine operating at relatively lower load.

11. An engine as set forth in claim 9 wherein the engine control system causes the direction control valve to allow exhaust gas flow to the second EGR valve, causes the first EGR valve to be closed, and sets the extent to which the second EGR valve is allowed to open when the processing result discloses the engine operating at relatively higher load.

12. A turbocharged compression ignition engine comprising:

engine cylinders within which combustion occurs to run the engine;

an intake system through which charge air is introduced into the cylinders;

an exhaust system through which products of combustion from the engine cylinders are exhausted;

a turbocharger having a turbine in the exhaust system and a compressor in the intake system;

an exhaust gas recirculation system for conveying exhaust gas from the exhaust system to the intake system to aid in limiting in-cylinder combustion temperature comprising a first EGR loop comprising a first EGR valve and a second EGR loop comprising a second EGR valve for selectively recirculating exhaust gas and a direction control valve for controlling flow through the EGR loops;

and an engine control system for selectively operating the direction control valve to select one of the EGR loops to convey exhaust gas from the exhaust system to the intake system to the exclusion of the other of the EGR loops, wherein selection of the first EGR loop causes exhaust gas to be recirculated from a location upstream of the turbine through the first EGR valve and the direction control valve to a location downstream of the compressor and selection of the second EGR loop causes exhaust gas to be recirculated from a location downstream of the turbine through the second EGR valve and the direction control valve to a location upstream of the compressor.

13. A method of controlling exhaust emission during operation of a turbocharged compression ignition engine having engine cylinders within which combustion occurs to run the engine, an intake system through which charge air is introduced into the cylinders, an exhaust system through which products of combustion from the engine cylinders are exhausted, a turbocharger having a turbine in the exhaust system and a compressor in the intake system, a fueling system for fueling the cylinders, and an exhaust gas recirculation system for conveying exhaust gas from the exhaust system to the intake system to aid in limiting in-cylinder combustion temperature, the method comprising, selectively operating a direction control valve for selecting between a first EGR loop containing a first EGR valve and a second EGR loop containing a second EGR valve to recirculate exhaust gas, wherein selection of the first EGR loop causes exhaust gas to be recirculated from a location upstream of the turbine through the direction control valve and first EGR valve to a location downstream of the compressor and selection of the second EGR loop causes exhaust gas to be recirculated from a location downstream of the turbine through the direction control valve and the second EGR valve to a location upstream of the compressor.

14. A method as set forth in claim 13 wherein the exhaust system comprises an exhaust gas treatment device downstream of the turbine, and when the second EGR loop is selected, exhaust gas is recirculated from a location downstream of the exhaust gas treatment device.

15. A method as set forth in claim 13 wherein the exhaust system comprises a diesel particulate filter downstream of the turbine, and when the second EGR loop is selected, exhaust gas is recirculated from a location downstream of the diesel particulate filter.

16. A method as set forth in claim 13 wherein the intake system comprises an intercooler downstream of the compressor, and when the first EGR loop is selected, exhaust gas is recirculated to a location in the intake system downstream of the intercooler.

17. A method as set forth in claim 13 including controlling the fueling system to cause the engine to operate, at least at times, by an alternative diesel combustion process.

18. A method as set forth in claim 13 wherein the step of selectively operating a direction control valve for selecting between a first EGR loop containing a first EGR valve and a second EGR loop containing a second EGR valve includes controlling recirculation of exhaust gas by controlling the first EGR valve when the direction control valve is in a first operating condition and controlling recirculation of exhaust gas by controlling the second EGR valve when the direction control valve is in the a second operating condition.

19. A method as set forth in claim 18 comprising operating the second EGR valve closed when the direction control valve is in the first operating condition and operating the first EGR valve closed when the direction control valve is in the second operating condition.

20. A method as set forth in claim 12 wherein the step of selectively operating a direction control valve for selecting between a first EGR loop containing a first EGR valve and a second EGR loop containing a second EGR valve comprises processing data values indicative of engine load and operating the direction control valve to select one of the EGR loops according to a result of the processing.

21. A method as set forth in claim 20 wherein the step of operating the direction control valve to select one of the EGR loops according to a result of the processing comprises operating the direction control valve to select the first EGR loop when a result of the processing discloses relatively lower engine load and operating the direction control valve to select the second EGR loop when a result of the processing discloses relatively higher engine load.

* * * * *